US009771724B2

(12) United States Patent
Ohshima et al.

(10) Patent No.: US 9,771,724 B2
(45) Date of Patent: Sep. 26, 2017

(54) FLOOR PANEL

(71) Applicant: SENQCIA CORPORATION, Tokyo (JP)

(72) Inventors: Takashi Ohshima, Saitama (JP); Atsuhiko Kobayashi, Tokyo (JP); Tsukasa Matsuzaki, Saitama (JP); Yuichi Nakabo, Saitama (JP)

(73) Assignee: SENQCIA CORPORATION, Tokyo (JP)

( * ) Notice: Subject to any disclaimer, the term of this patent is extended or adjusted under 35 U.S.C. 154(b) by 56 days.

(21) Appl. No.: 14/346,113

(22) PCT Filed: Sep. 27, 2013

(86) PCT No.: PCT/JP2013/076372
§ 371 (c)(1),
(2) Date: Mar. 20, 2014

(87) PCT Pub. No.: WO2015/045124
PCT Pub. Date: Apr. 2, 2015

(65) Prior Publication Data

US 2016/0201340 A1 Jul. 14, 2016

(51) Int. Cl.
*E04F 15/02* (2006.01)
*E04F 15/024* (2006.01)
(Continued)

(52) U.S. Cl.
CPC ..... *E04F 15/02405* (2013.01); *E04B 5/02* (2013.01); *E04C 2/34* (2013.01);
(Continued)

(58) Field of Classification Search
CPC ..... E04F 15/02405; E04F 15/2429; E04F 15/02005; E04B 5/02; E04C 2/50; E04C 2/38; E04C 2/34; B29C 63/04
(Continued)

(56) References Cited

U.S. PATENT DOCUMENTS 1,930,345 A * 10/1933 Lewis ..... E04C 2/384 52/792.1
3,924,370 A * 12/1975 Cauceglia ..... E04F 15/02435 52/126.6

(Continued)

FOREIGN PATENT DOCUMENTS

JP H1150645 A 2/1999
JP 2003532816 A 11/2003
JP 2009144378 A 7/2009

*Primary Examiner* — Paola Agudelo
(74) *Attorney, Agent, or Firm* — Bacon & Thomas, PLLC.

(57) ABSTRACT

In a floor panel provided with upper and lower members which have concave spaces and side surfaces having heights and are formed as a box shape, and structured such that the upper and lower members are combined up and down so as to communicate the respective concave spaces so as to form an internal space in an inner portion, the floor panel has a joint portion in which height leading end portions of the side surfaces of the upper and lower members are folded so as to enwrap each other so as to be connected, and the joint portion is arranged in a height midstream portion of the side surface of the floor panel, and is arranged at a position which is retreated to an inner side of the floor panel in relation to the side surface in both height end sides of the floor panel.

8 Claims, 14 Drawing Sheets

(51) Int. Cl.
*E04B 5/02* (2006.01)
*E04C 2/34* (2006.01)
*E04C 2/38* (2006.01)

(52) U.S. Cl.
CPC ..... *E04C 2/38* (2013.01); *E04C 2/50* (2013.01); *E04F 15/0247* (2013.01); *E04F 15/02423* (2013.01); *E04F 15/02452* (2013.01)

(58) Field of Classification Search
USPC ..... 52/792.1, 792.11
See application file for complete search history.

(56) References Cited

U.S. PATENT DOCUMENTS 4,411,121 A * 10/1983 Blacklin ..... E04C 2/326 52/630
4,856,256 A * 8/1989 Tokuzo ..... E04F 15/02429 52/789.1
4,944,130 A * 7/1990 Pallhorn ..... E04F 15/02441 52/263
4,996,818 A * 3/1991 Bettinger ..... E04F 15/02405 52/126.6
5,046,291 A * 9/1991 Narayan ..... E04F 15/02435 52/126.6
5,115,621 A * 5/1992 Kobayashi ..... E04F 15/02441 52/630
6,418,697 B1 * 7/2002 Da Molin ..... E04F 15/02405 52/263
8,341,920 B2 * 1/2013 Tavarez ..... E06B 3/76 52/458
2003/0154682 A1 * 8/2003 Liviero ..... E04F 15/02405 52/578
2006/0053559 A1 * 3/2006 Vantilt ..... B32B 3/04 5/690
2007/0175132 A1 * 8/2007 Spransy ..... E04F 15/02405 52/263

* cited by examiner (PRIOR ART)

(PRIOR ART)

(PRIOR ART)

(PRIOR ART)

FLOOR PANEL

BACKGROUND OF THE INVENTION

Field of the Invention

The present invention relates to a floor panel which is used in a free access floor.

Description of the Conventional Art

The floor panel according to the present invention is used in the free access floor. The floor panel of the free access floor is provided above a foundation floor surface which is formed by a concrete material and constructs a part of a building construction, so as to be spaced (refer, for example, to patent document 1).

FIGS. 8 to 11 are views which are referred for describing a conventional floor panel 2. The conventional floor panel 2 constructs a free access floor 1 together with a support leg 4 which is provided in a rising manner on a foundation floor surface 3, as shown in FIG. 8.

The floor panel 2 is arranged on a horizontal surface having a height spaced above from the foundation floor surface 3 so as to be adjacent to each other in both vertical and horizontal axial directions as seen from the above, and four corner portions of the floor panel 2 are detachably supported to the support legs 4 which are provided in a rising manner on the foundation floor surface 3.

The floor panel 2 is constructed as shown by FIGS. 9 and 11, by mainly combining a top plate 6 formed approximately as a tabular shape so that an upper surface 6*c* is formed approximately as a square shape, and a bottom plate 8 formed as a box shape having a bottom surface 8*c* which is approximately formed as a square shape in the same manner as the upper surface 6*c* and having a depth, vertically so that a top plate portion 6*a* and a bottom plate portion 8*a* are opposed to each other, as shown in FIG. 10. The top plate 6 and the bottom plate 8 are both constructed by using a steel plate member.

In the bottom plate 8 of the floor panel 2, as shown in FIG. 11, there is formed a side plate portion 8*b* obtained by folding the bottom plate portion 8*a* approximately vertically from a peripheral edge portion toward an upper side in the drawing, and a peripheral edge portion 8*f* folded approximately vertically toward a right side in the drawing is formed in an upper end portion of the side plate portion 8*b*. As a result, the bottom plate 8 is formed as a box shape having a concave space 8*d* which is formed in an inner side in a horizontal direction of the side plate portion 8*b*.

Further, since a U-shaped portion 6*b* folded like a U-shaped form so as to enwrap the peripheral edge portion 8*f* of the bottom plate 8 is formed in the peripheral edge portion 6*f* of the top plate 6, the peripheral edge portion 6*f* of the top plate 6 is connected to the peripheral edge portion 8*f* of the bottom plate 8.

As mentioned above, the floor panel 2 is formed as a hollow shape having an internal space 10 by integrally connecting the top plate 6 and the bottom plate 8. Further, the internal space 10 is provided with a reinforcing member 12 having a thickness.

However, since the bottom plate 8 is obtained by a deep drawing process of a plate-like member while using a pressing machine, such a tension force that the bottom plate 8 is extended in a depth direction (a vertical direction in FIG. 11) is applied. Therefore, there is a problem that a crack or a breaking may be easily generated in the side plate portion 8*b* of the bottom plate 8 in the case that the thickness becomes smaller.

FIGS. 9 and 12 to 14 are views which are referred for describing a conventional floor panel 20. The conventional floor panel 20 is constructed, as shown in FIG. 9, by mainly combining a top plate 26 in which an upper surface 26*c* is formed approximately as a square box shape, and a bottom plate 28 in which a bottom surface 28*c* corresponding to the upper surface 26*c* is formed approximately as a square box shape, vertically as shown in FIG. 12.

A side plate portion 26*b* is formed in the top plate 26 of the floor panel 20, the side plate portion 26*b* being formed by folding the top plate portion 26*a* approximately vertically from a peripheral edge portion thereof to a lower side in the drawing, and a side plate portion 28*b* is formed in the bottom plate 28 of the floor panel 20, the side plate portion 28*b* being formed by folding the bottom plate portion 28*a* approximately vertically from a peripheral edge portion thereof toward an upper side in the drawing, as shown in FIG. 13.

As a result, the top plate 26 is formed as a box shape having a concave space 26*d* which is formed in an inner side in a horizontal direction of the side plate portion 26*b*. Further, the bottom plate 28 is also formed as a box shape having a concave space 28*d* which is formed in an inner side in a horizontal direction of the side plate portion 28*b*.

Further, in the floor panel 20, concave spaces 26*d* and 28*d* of the top plate 26 and the bottom plate 28 are arranged so as to be communicated with each other, and a peripheral edge portion 26*j* and a peripheral edge portion 28*j* are folded as a U-shaped form so as to enwrap respective leading end portions, thereby being connected in a joint portion 25 approximately in the center portion in a vertical direction in FIG. 13 of the floor panel 20, the peripheral edge portion 26*j* being formed in a lower end portion side of the side plate portion 26*b* of the top plate 26, and the peripheral edge portion 28*j* being formed in an upper end portion side of the side plate portion 28*b* of the bottom plate 28.

As mentioned above, since the top plate 26 and the bottom plate 28 are integrally connected in the joint portion 25, the floor panel 20 is formed as a hollow shape having an internal space 30. Further, a reinforcing member 32 having a thickness is provided in the internal space 30.

As mentioned above, since it is possible to make depths of the concave space 26*d* of the top plate 26 and the concave space 28*d* of the bottom plate 28 approximately half of a depth of the concave space 8*d* of the bottom plate in the floor panel 2, it is possible to make a height at which the side plate portions 26*b* and 28*b* are extended by a deep drawing process smaller than a height at which the side plate portion 8*b* of the bottom plate 8 is extended by a deep drawing process, at that degree.

As a result, since it is possible to reduce a tension force which is applied at the time of the deep drawing process of the top plate 26 and the bottom plate 28, it is possible to prevent a crack and a breaking from being easily generated at the time of the forming process even in the case that the thicknesses of the top plate 26 and the bottom plate 28 are reduced.

PRIOR ART DOCUMENT

Patent Document

Patent Document 1: Japanese Unexamined Patent Publication No. 2009-144378

SUMMARY OF THE INVENTION

Problem to be Solved by the Invention

However, in the conventional floor panel 2, as shown in FIG. 14, there is a problem that the joint portion 25 connecting the top plate 26 and the bottom plate 28 protrudes to an outer side in the horizontal direction (a right side in the drawing) in relation to the side plate portion 26*b* of the top plate 26, and a dimensional precision of the floor panel 20 is deteriorated.

In other words, as mentioned above, in the joint portion 25, the peripheral edge portion 26*j* formed in the lower end portion side of the side plate portion 26*b* in the top plate 26 and the peripheral edge portion 28*j* formed in the upper end portion side of the side plate portion 28*b* in the bottom plate 28 are folded as the U-shaped form so as to enwrap the respective leading end portions (refer to FIG. 13).

Further, the joint portion 25 is folded back approximately in parallel to the side plate portions 26*b* and 28*b*, and is pressed to a left side in FIG. 13 so as not to protrude to the outer side in the horizontal direction in relation to the side plate portion 26*b*. However, there is a case that the joint portion 25 protrudes to the outer side in the horizontal direction (the right side in the drawing) in relation to the outer peripheral surface (the right surface in the drawing) of the side plate portion 26*b*, due to a thereafter elastic deformation of the peripheral edge portions 26*j* and 28*j*, as shown in FIG. 14.

As a result, there is a case that the joint portion 25 protrudes to the outer side in the horizontal direction in relation to the outer peripheral surface of the side plate portion 26*b* in the top plate 26, the dimensional precision of the side surface portion of the floor panel 20 is deteriorated, and the joint portion 25 interferes with the other floor panel 20 which is arranged adjacently.

Further, in the case that the joint portion 25 protrudes to the outer side in the horizontal direction in relation to the outer peripheral surface of the side plate portion 26*b* in the top plate 26, the protruding joint portion 25 catches on the other member or a worker at the time of installing work of the floor panel 20 or the time of thereafter maintaining work, so that there is a problem that a workability is deteriorated.

Accordingly, the present invention is made by taking the problem mentioned above into consideration, and an object of the present invention is to provide a floor panel which can prevent a crack or a breaking from being easily generated at the time of forming process, and can improve a dimensional precision and a workability.

Means for Solving the Problem

In order to solve the problem mentioned above, according to the present invention, there is provided a floor panel comprising:

an upper member which has a concave space and a side surface having a height and is formed as a box shape;

a lower member which has a concave space and a side surface having a height and is formed as a box shape; and the upper member and the lower member being combined up and down so as to communicate the respective concave spaces so as to form an internal space in an inner portion, wherein the floor panel has a joint portion in which height leading end portions of the side surfaces of the upper member and the lower member are folded so as to enwrap each other so as to be connected, and wherein the joint portion is arranged in a height midstream portion of the side surface of the floor panel, and is arranged at a position which is retreated to an inner side of the floor panel in relation to the side surface in both height end sides of the floor panel.

Further, according to the present invention, there is provided the floor panel, wherein the upper member has an upper concave portion which is formed so as to retreat to the inner side of the floor panel in relation to an upper end portion side of the side surface, in a lower end portion side of the side surface of the upper member, wherein the lower member has a lower concave portion which is formed so as to retreat to the inner side of the floor panel in relation to a lower end portion side of the side surface, in an upper end portion side of the side surface of the lower member, and wherein an upper peripheral edge portion formed in the lower end portion side of the upper concave portion and a lower peripheral edge portion formed in the upper end portion side of the lower concave portion are folded so as to enwrap each other, whereby the joint portion is formed.

Further, according to the present invention, there is provided the floor panel, wherein the upper member and the lower member are connected in a height center portion of the side surface of the floor panel.

Further, according to the present invention, there is provided the floor panel, wherein a reinforcing member is provided in the inner space which is formed between the upper member and the lower member.

Effect of the Invention

According to the floor panel of the present invention mentioned above, in the floor panel provided with the upper member which has the concave space and the side surface having the height and is formed as the box shape, and the lower member which has the concave space and the side surface having the height and is formed as the box shape, and structured such that the upper member and the lower member are combined up and down so as to communicate the respective concave spaces so as to form the internal space in the inner portion, the floor panel has the joint portion in which the height leading end portions of the side surfaces of the upper member and the lower member are folded so as to enwrap each other so as to be connected, and the joint portion is arranged in the height midstream portion of the side surface of the floor panel, and is arranged at the position which is retreated to the inner side of the floor panel in relation to the side surface in both height end sides of the floor panel. Accordingly, it is possible to prevent a crack or a breaking from being easily generated at the time of the forming work, and it is possible to improve a dimensional precision and a workability.

DESCRIPTION OF REFERENCE NUMERALS

Figure 1:
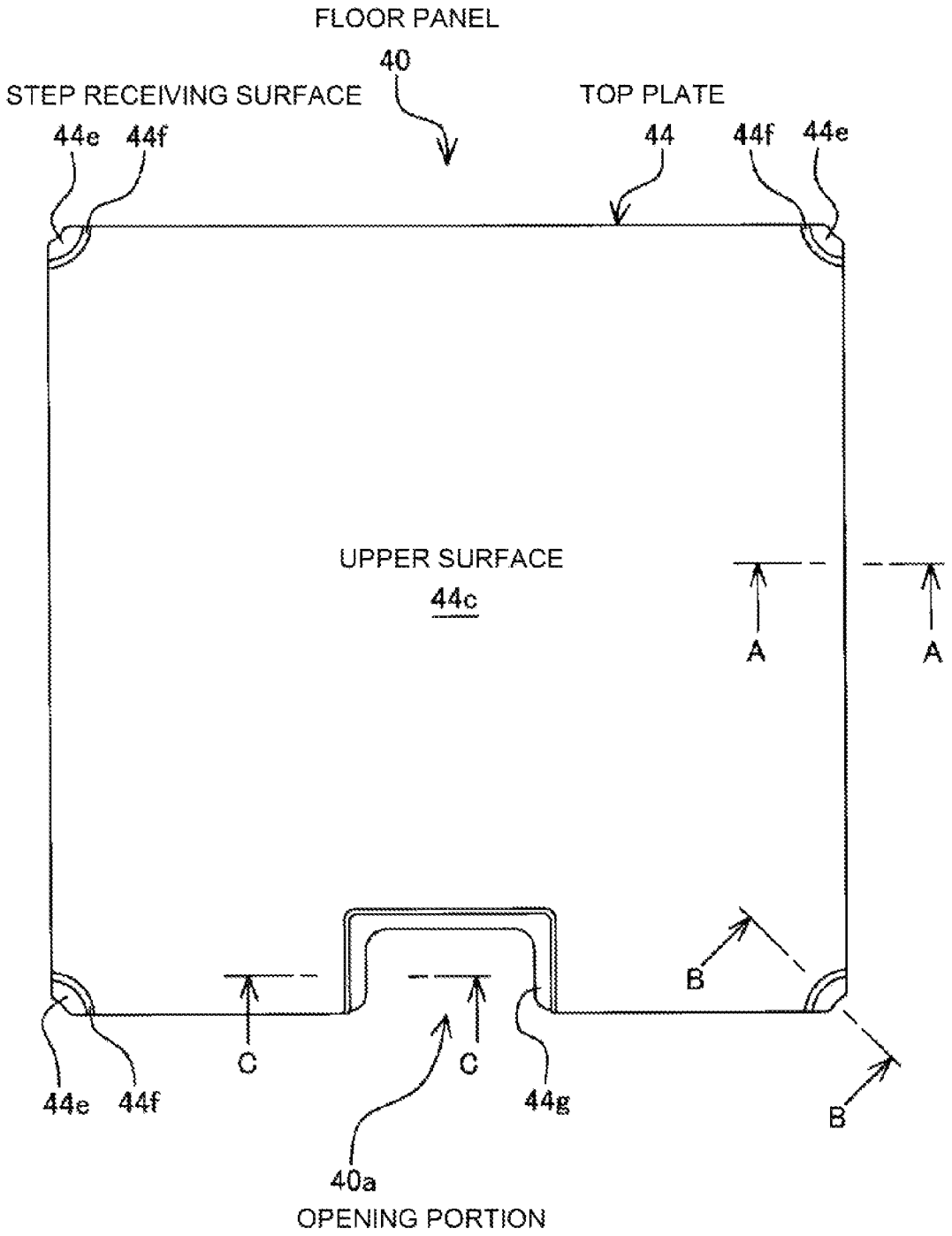
FIG. 1 is a top elevational view of a floor panel 40 according to an embodiment of the present invention.

1 free access floor
2 floor panel
2*a* opening portion
3 foundation floor surface
4 support leg
5 joint portion
6 top plate
6*a* top plate portion
6*b* U-shaped portion
6*c* upper surface
6*d* concave space
8 bottom plate
8*a* bottom plate portion
8*b* side plate portion
8*c* bottom surface
8*d* concave space
8*f* peripheral edge portion
10 internal space
12 reinforcing member
15 male thread member
17 flat head bolt
17*a* flat head portion
17*b* male thread portion
18 lid member
20 floor panel
20*a* opening portion
25 joint portion
26 top plate
26*a* top plate portion
26*b* side plate portion
26*c* upper surface
26*d* concave space
26*j* peripheral edge portion
28 bottom plate
28*a* bottom plate portion
28*b* side plate portion
28*c* bottom surface
28*d* concave space
28*j* peripheral edge portion
30 internal space
32 reinforcing member
40 floor panel
40*a* opening portion
41 free access floor
44 top plate
42 support leg
44*a* top plate portion
44*b* side plate portion
44*c* upper surface
44*d* concave space
44*e* step receiving surface
44*f* connection portion
44*g* step receiving surface
44*h* connection portion
44*j* peripheral edge portion
44*m* connection portion
44*k* concave portion
45 joint portion
46 bottom plate
46*a* bottom plate portion
46*b* side plate portion
46*c* bottom plate
46*d* concave space
46*j* peripheral edge portion
46*m* connection portion
46*k* concave portion
50 reinforcing member
56 panel adjusting table
56*a* support surface
56*b* female thread hole
58 leg portion
58*a* male thread portion

DETAILED DESCRIPTION OF PREFERRED EMBODIMENT

A description will be specifically given below of a mode for carrying out a floor panel according to the present invention with reference to the accompanying drawings.

FIGS. 1 to 7 are views which are referred for describing a floor panel 40 according to an embodiment of the present invention.

Figure 2:
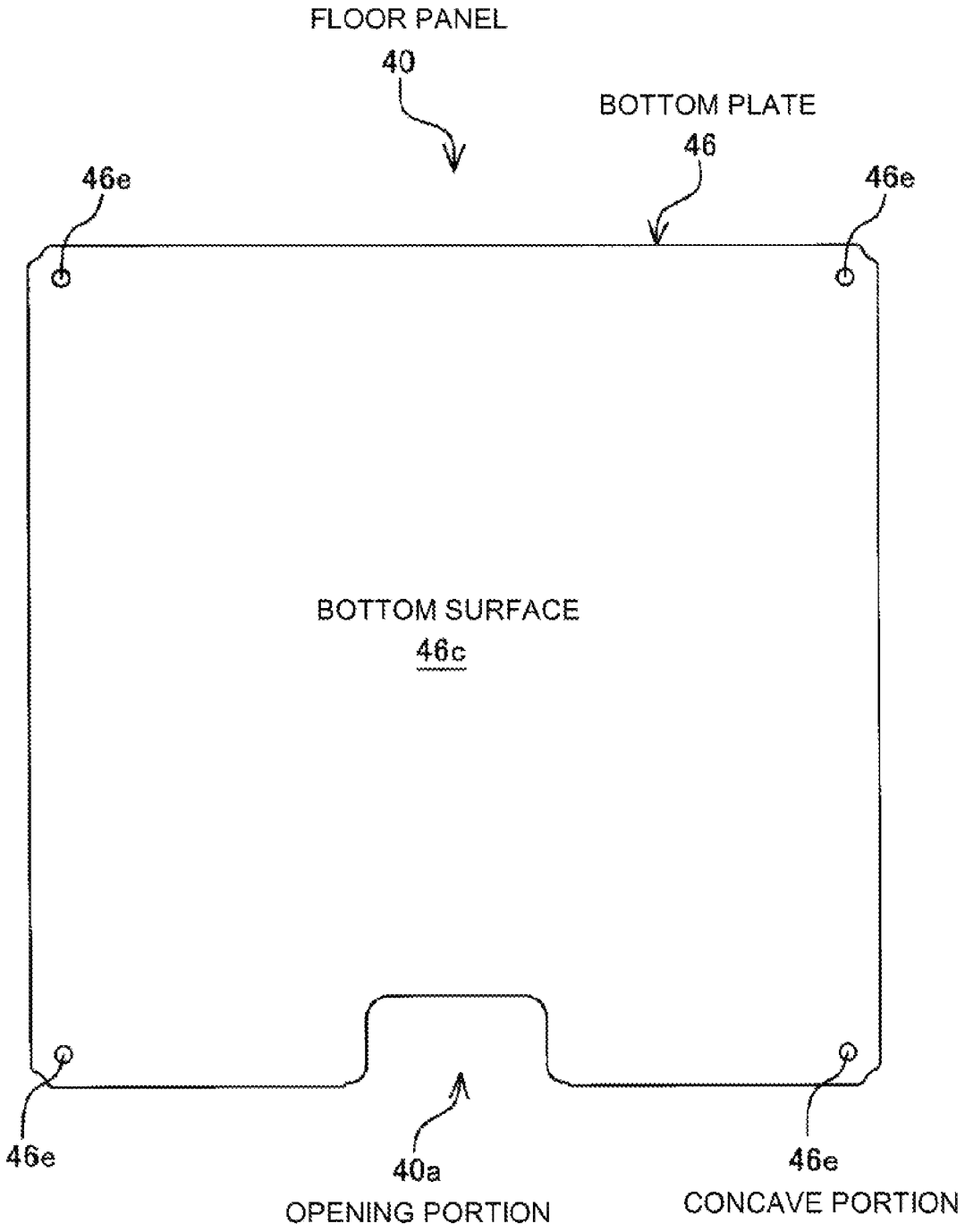
FIG. 2 is a bottom elevational view of the floor panel 40 shown in FIG. 1.
Figure 3:
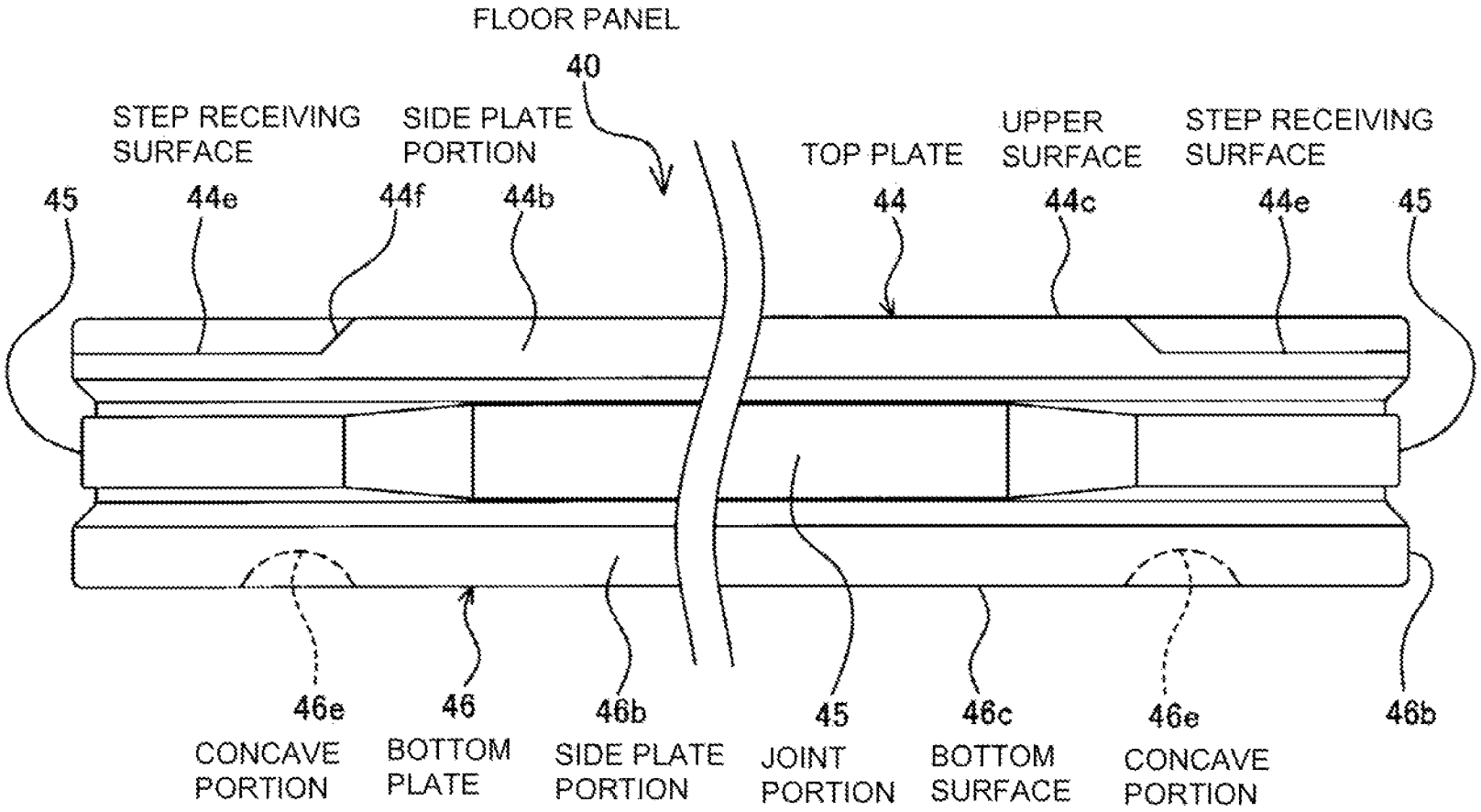
FIG. 3 is a side elevational view showing an outline of the floor panel 40 shown in FIG. 1.

The floor panel 40 according to the present embodiment is constructed, as shown in FIGS. 1 and 2, mainly by combining a top plate 44 (an upper member) in which an upper surface 44*c* is formed approximately as a square shape, and a bottom plate 46 (a lower member) in which a bottom surface 46*c* corresponding to the upper surface 44*c* is formed approximately as a square shape, from up and down as shown in FIG. 3.

The top plate 44 and bottom plate 46 are formed, for example, by a press drawing process while using a steel plate member such as SGCC. Further, the top plate 44 and the bottom plate 46 are combined vertically as shown in FIG. 4, and are connected in a joint portion 45 in a height center portion of a side surface of the floor panel 40.

Figure 4:
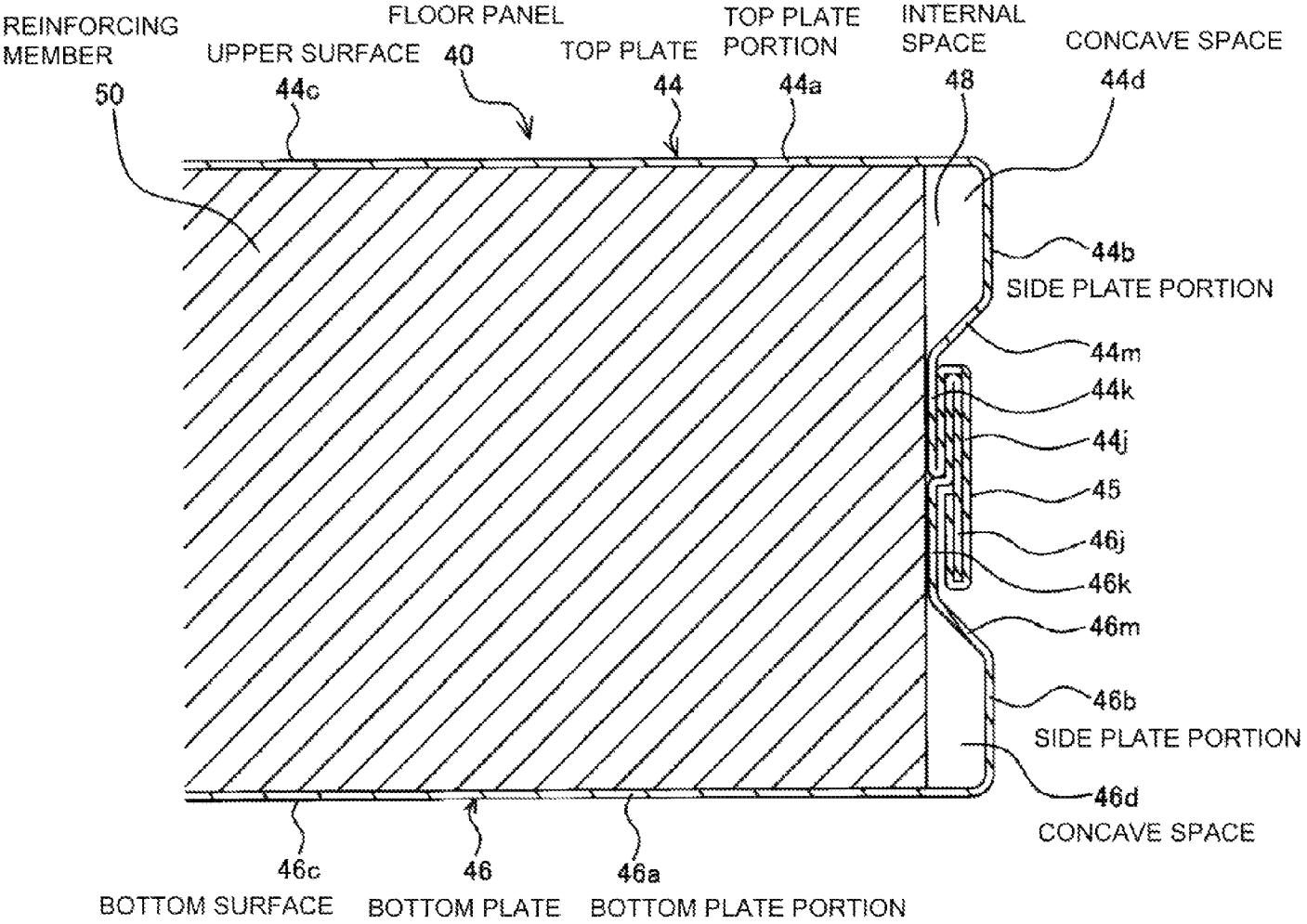
FIG. 4 is a cross sectional view of the floor panel 40 shown in FIG. 1 as seen from an arrow A-A.

As shown in FIG. 4, a side plate portion 44*b* is formed in the top plate 44 of the floor panel 40 by folding a top plate portion 44*a* of the top plate 44 approximately vertically from a peripheral edge portion toward a lower side in the drawing, and a connection portion 44*m* having an inclined surface inclined at a predetermined angle is formed from a lower end portion of the side plate portion 44*b* toward an inner direction (a leftward direction in the drawing) of the floor panel 40.

Further, a concave portion 44*k* (an upper concave portion) is formed in the top plate 44 so as to extend from a lower end portion of the connection portion 44*m* toward a lower side in FIG. 4 approximately in parallel to the side plate portion 44*b*, and a peripheral edge portion 44*j* (an upper peripheral edge portion) is formed so as to be folded at plural times like a U-shaped form from a leading end portion below the concave portion 44*k*.

Further, a side plate portion 46*b* is formed in the bottom plate 46 of the floor panel 40, as shown in FIG. 4, by folding a bottom plate portion 46*a* approximately vertically from a peripheral edge portion of the bottom plate portion 46*a* toward an upper side in the drawing, and a connection portion 46*m* having an inclined surface in which the side plate portion 46*b* is inclined at a predetermined angle from an upper end portion of the side plate portion 46*b* toward an inner direction (a leftward direction in the drawing) of the floor panel 40.

Further, a concave portion 46*k* (a lower concave portion) is formed in the bottom plate 46, the concave portion 46*k* extending from an upper end portion of the connection portion 46*m* toward an upper side in the drawing so as to be approximately parallel to the side plate portion 46*b*, and a peripheral edge portion 46*j* (a lower peripheral edge portion) is formed by being folded as a U-shaped form from a leading end portion above the concave portion 46*k*, as shown in FIG. 4.

As a result, the top plate 44 is formed as a box shape having a concave space 44*d* which is formed in an inner side in a horizontal direction of the side plate portion 44*b*, the connection portion 44*m*, the concave portion 44*k* and the peripheral edge portion 44*j* and over a height direction. Further, the bottom plate 46 is formed in the same manner as a box shape having a concave space 46*d* which is formed in an inner side in a horizontal direction of the side plate portion 46*b*, the connection portion 46*m*, the concave portion 46*k* and the peripheral edge portion 46*j* and over a height direction.

Further, the top plate 44 and the bottom plate 46 are arranged so as to communicate the concave spaces 44*d* and 46*d* of the top plate 44 and the bottom plate 46 with each other, as shown in FIG. 4.

Further, as shown in FIG. 4, since the peripheral edge portion 44*j* of the top plate 44 and the peripheral edge portion 46*j* of the bottom plate 46 are folded like the U-shaped form so as to enwrap each other and be approximately in parallel to the side plate portions 44*b* and 46*b*, the top plate 44 and the bottom plate 46 are connected by the joint portion 45 approximately in the center portion in the vertical direction in FIG. 4 of the floor panel 40.

As mentioned above, since it is possible to make the depth of the concave space 44*d* of the top plate 44 and the concave space 46*d* of the bottom plate 46 approximately half of the depth of the concave space 8*d* of the bottom plate 8 in the conventional floor panel 2, it is possible to make a height with which the side plate portions 44*b* and 46*b* are extended by a deep drawing process smaller than a height with which the side plate portion 8*b* of the bottom plate 8 in the floor panel 2 is extended by a deep drawing process, at that degree.

Therefore, since it is possible to reduce a tension force which is applied in the case of the deep drawing process of the top plate 44 and the bottom plate 46, it is possible to prevent the crack or the breaking from being easily generated at the time of forming process even in the case that the thicknesses of the top plate 44 and the bottom plate 46 are reduced.

Further, the joint portion 45 formed by folding the peripheral edge portion 44*j* of the top plate 44 and the peripheral edge portion 46*j* of the bottom plate 46 is pressed toward the inner side of the floor panel 40 (the left side in FIG. 4) so as to come into contact with the concave portion 44*k* (refer to FIG. 4) of the top plate 44.

The concave portion 44*k* of the top plate 44 is formed at a position which is retreated to the inner side of the floor panel 40 in relation to the side plate portion 44*b*, and the concave portion 46*k* of the bottom plate 46 is formed at a position which is retreated to the inner side of the floor panel 40 in relation to the side plate portion 46*b*.

As a result, the joint portion 25 pressed toward the inner side of the floor panel 40 is housed at a position which is retreated to the left side in FIG. 4 in relation to an outer peripheral surface of the side plate portion 44*b* and the side plate portion 46*b* (the right end surface in FIG. 4 of the floor panel 40).

In other words, the joint portion 45 is arranged in a height center portion of the side surface of the floor panel 40, and is arranged at a position which is retreated to the inner side of the floor panel 40 in relation to the side surfaces in both height end sides of the floor panel 40 (the outer peripheral surfaces of the side plate portions 44*b* and 46*b*), such that a single indented portion is formed between the upper and lower concave portions.

As a result, even in the case that the joint portion 45 deforms so as to return toward the outer side in the horizontal direction of the floor panel 40 (the right side in FIG. 4) due to a thereafter elastic deformation of the peripheral edge portions 44*j* and 46*j*, the joint portion 45 can be prevented from protruding to the outer side in the horizontal direction (the right side in FIG. 4) in relation to the outer peripheral surfaces of the side plate portions 44*b* and 46*b* (the right end surface in FIG. 4 of the floor panel 40).

Therefore, since the joint portion 45 connecting the top plate 44 and the bottom plate 46 does not protrude to the outer side in the horizontal direction in relation to the outer peripheral surfaces of the side plate portions 44*b* and 46*b*, it is possible to improve a dimensional precision of the side surface portion of the floor panel 40, and it is possible to prevent the joint portion 45 from interfering with the other floor panel 40 which is arranged adjacently.

Further, since the joint portion 45 does not protrude to the outer side in the horizontal direction in relation to the outer peripheral surfaces of the side plate portions 44*b* and 46*b*, the joint portion 45 can be prevented from catching on the other member or the worker at the time of installing the floor panel 40 or the time of the maintenance work after the installation, and it is possible to improve a workability.

Since the top plate 44 and the bottom plate 46 are integrally connected by the joint portion 45 (refer to FIGS. 4 to 6), the floor panel 40 can be formed as a hollow shape having an internal space 48, and a plate-like reinforcing member 50 having a thickness is housed in the internal space 48 in order to improve a strength of the floor panel 40.

The reinforcing member 50 is sandwiched between the top plate portion 44*a* of the top plate 44 and the bottom plate portion 46*a* of the bottom plate 46, and is provided so as to be along the side plate portions 44*b* and 46*b* and the concave portions 44*k* and 46*k*. Further, the reinforcing member 50 employs a particle board which is formed by breaking a wood into small wood pieces so as to dry, and molding under a high temperature and high pressure while adding an adhesive agent.

The top plate 44 of the floor panel 40 is formed, as shown in FIG. 1, in its four corner portions circular arc shaped connection portions 44*f* each of which is formed in its plane shape as a circular arc shape obtained by dividing a circle into four sections, and circular arc shaped step receiving surfaces 44*e* each of which is formed in its plane shape as a circular arc shape obtained by dividing a circle into four sections, in a radially inner side of the connection portion 44*f*.

Figure 5:
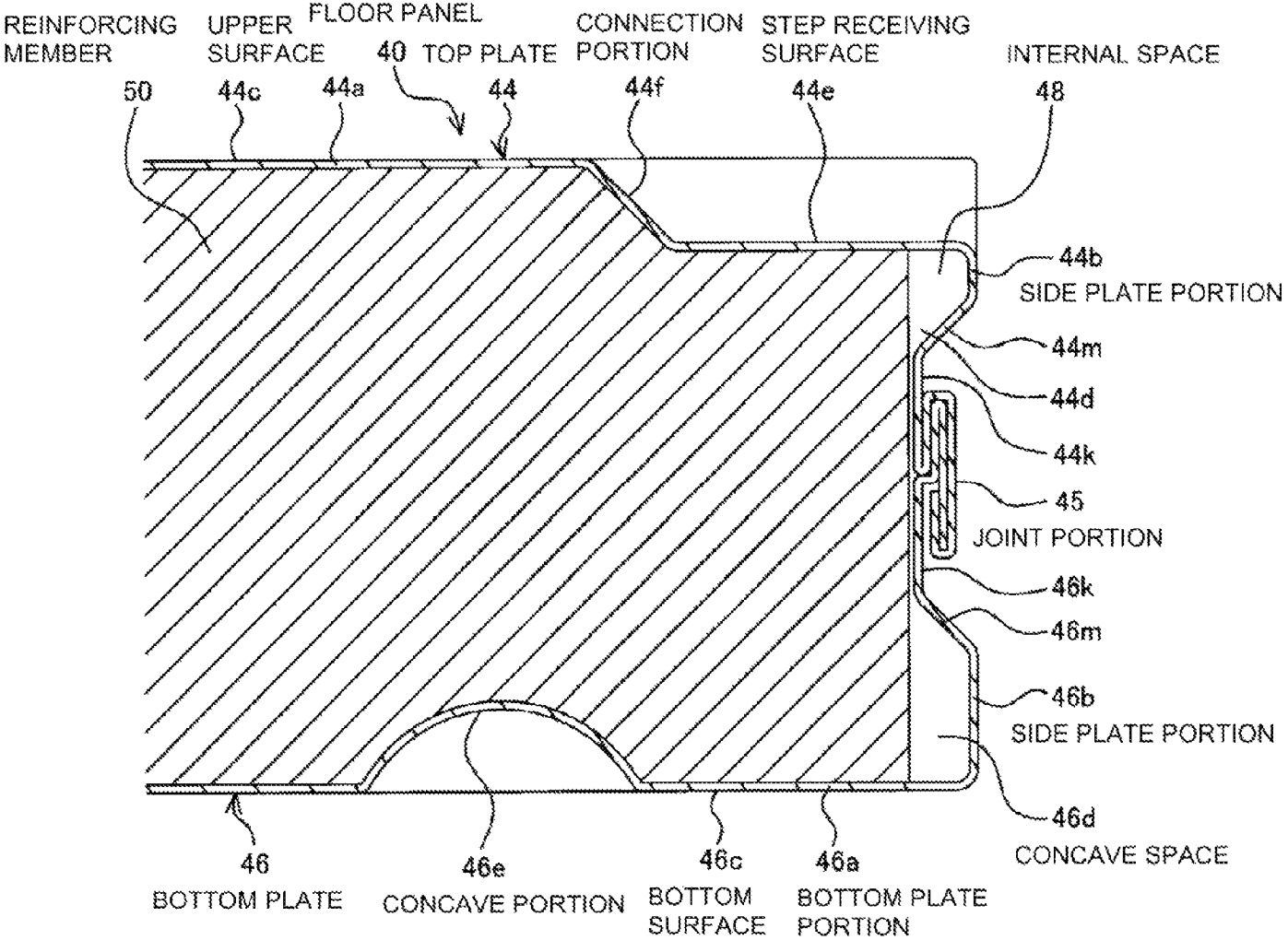
FIG. 5 is a cross sectional view of the floor panel 40 shown in FIG. 1 as seen from an arrow B-B.

In other words, the connection portion 44*f* and the step receiving surfaces 44*e* are formed in each of four corner portions of the top plate 44, the connection portion 44*f* being formed as a taper shape which is inclined in its vertical cross section at a predetermined angle, and the step receiving surface 44*e* extending in parallel to the upper surface 44*c* of the top plate 44 (horizontally) from the lower end portion of the connection portion 44*f* and in a radial direction, and having a low step in relation to the upper surface 44*c*, as shown in FIG. 5.

Further, as shown in FIGS. 1 and 2, an opening portion 40*a* is formed in the floor panel 40 so as to intrude approximately like a rectangular shape into an inner side of a side edge portion of a lower edge (a lower side edge extending in a lateral direction of the drawing) which is one edge of the approximately square shape. The opening portion 40*a* is used for attaching a wall socket used for connecting an underfloor wiring to an office automation equipment installed on the floor panel 40.

Figure 6:
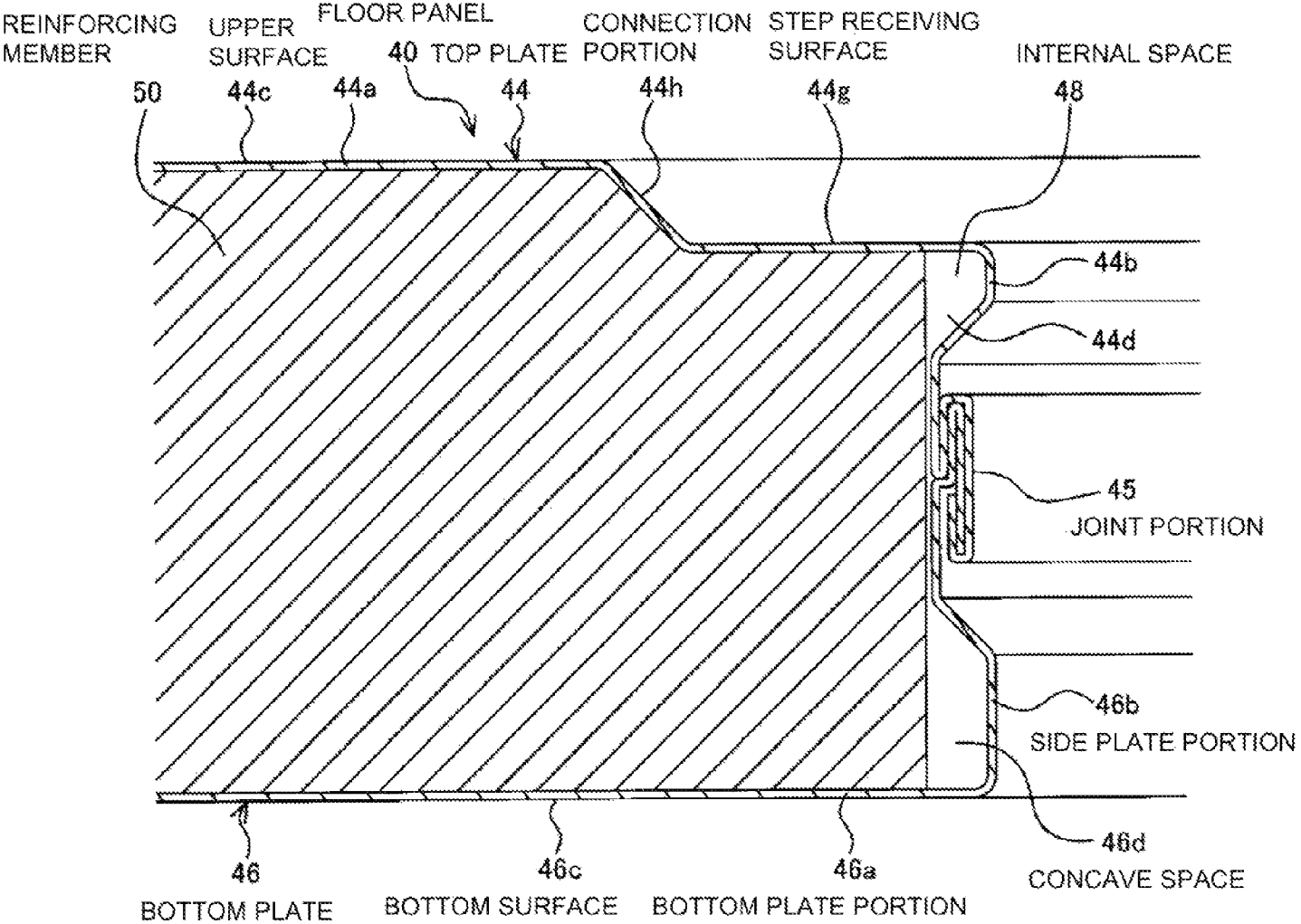
FIG. 6 is a cross sectional view of the floor panel 40 shown in FIG. 1 as seen from an arrow C-C.

Further, as shown in FIG. 6, a connection portion 44*h* and a step receiving surface 44*g* are formed in three edge portions which construct the opening portion 40*a* of the floor panel 40 and are formed approximately as a C-shaped form, the connection portion 44*h* being formed in its vertical cross section as a taper shape which is inclined at a predetermined angle, and the step receiving surface 44*g* extending from a lower end portion of the connection portion 44*h* in parallel to the upper surface 44*c* of the top plate 44 (horizontally) and in a width direction, and having a low step in relation to the upper surface 44*c*. The step receiving surface 44*g* is formed along three edge portions which construct the opening portion 40*a* of the floor panel 40 and are formed approximately as a C-shaped form.

Further, the opening portion 40*a* of the floor panel 40 is structured such as to be closed by brining a lower surface of a plate-like lid member 18 (refer to FIG. 8) into contact with the step receiving surface 44*g* of the top plate 44, the lid member 18 being formed so that its upper surface approximately forms the same plane shape as the upper surface 44*c* of the top plate 44.

Since the floor panel 40 is structured, as shown in FIGS. 5 and 6, such that the reinforcing member 50 is sandwiched between the step receiving surfaces 44*e* and 44*g* of the top plate 44, and the bottom plate portion 46*a* of the bottom plate 46 below the step receiving surfaces, the step receiving surfaces 44*e* and 44*g* can be improved its strength, and are hard to be deflected. As a result, it is possible to prevent the step receiving surfaces 44*e* and 44*g* from being deformed in the case that the load is applied from the upper side of the step receiving surfaces 44*e* and 44*g*.

Further, since the lid member 18 (refer to FIG. 8) mounted on the step receiving surface 44*g* of the top plate 44 can support the load applied from the upper side thereof with the step receiving surface 44*g*, it is possible to prevent the lid member 18 from being deformed.

Figure 7:
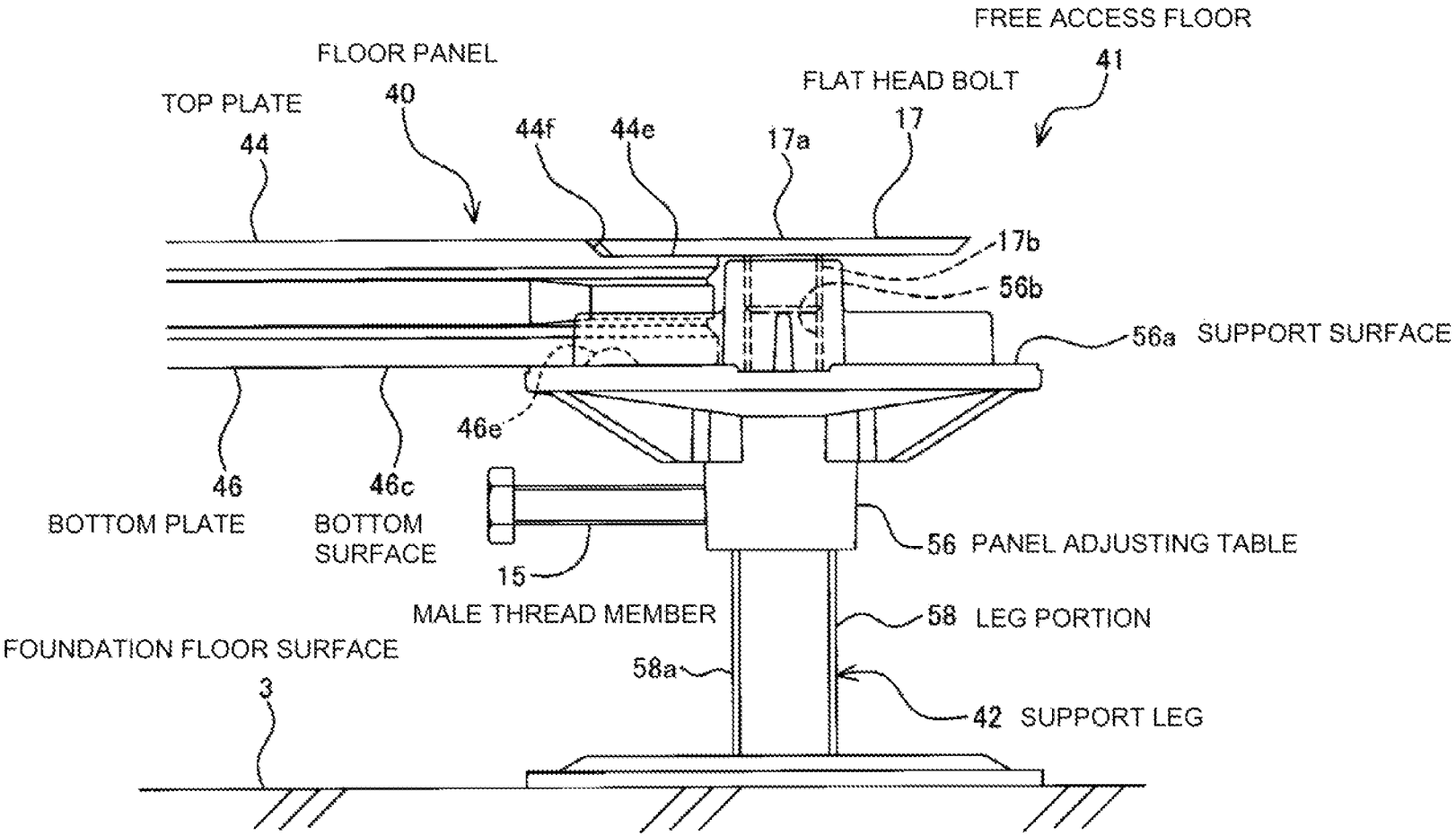
FIG. 7 is a partly side elevational view showing a free access floor 41 which is constructed by the floor panel 40 shown in FIG. 1, and support legs 42 supporting the floor panel 40.

The floor panel 40 is structured, as shown in FIG. 7, such as to construct a free access floor 41 together with support legs 42 which are provided in a rising manner on the foundation floor surface 3. Further, the support leg 42 supporting the floor panel 40 is constructed by a panel adjusting table 56 and a leg portion 58.

The panel adjusting table 56 of the support leg 42 adjusts a height position of the panel adjusting table 56 from the foundation floor surface 3 by relatively rotating the panel adjusting table 56 along a spiral track of a male thread portion 58*a* in a state in which the male thread portion 58*a* formed in an outer peripheral portion of the leg portion 58 is threadably joined to a female thread portion formed in a lower end side of an axial portion of the panel adjusting table 56.

Further, the panel adjusting table 56 is fixed to a desired height position from the foundation floor surface 3 by fastening a male thread member 15 to a female thread hole which is formed in a lower end portion of the panel adjusting table 56 and extends its axis in a radial direction.

A plurality of floor panels 40 are mounted on a support surface 56*a* of the panel adjusting table 56 in such a manner that four corner portions of the bottom surfaces 46*c* of a plurality of floor panels 40 are gathered to one position and confronted. Further, the step receiving surfaces 44*e* in four corner portions of the top plate 44 are pressed downward by a flat head portion 17*a* of a flat head bolt 17, by fastening a male thread portion 17*b* of the flat head bolt 17 into a female thread hole 56*b* in an upper end side of an axial portion of the panel adjusting table 56, and the floor panel 40 is fixed onto the support surface 56*a* of the panel adjusting table 56.

Semispherical concave portions 46*e* depressed to the upper surface 44*c* side of the top plate 44 (an upper side in FIG. 3) are formed in four corner portions of the bottom surface 46*c* of the bottom plate 46, as shown in FIG. 2. Further, since the concave portions 46*e* are fitted to semispherical convex portions provided in the support surface 56*a* in the case that four corner portions of the bottom surface 46*c* are mounted onto the support surface 56*a* of the panel adjusting table 56, the floor panel 40 mounted on the support legs 42 can be easily positioned.

Therefore, as described above, according to the floor panel 40 on the basis of the present embodiment, it is possible to prevent the crack or the breaking from being easily generated at the forming time, and it is possible to improve a dimensional precision and a workability.

The present invention is not limited only to the embodiment mentioned above, but can be variously modified in the floor panel as long as the purpose of the present invention can be achieved.

For example, in the floor panel 40 according to the embodiment mentioned above, the joint portion 45 connecting the top plate 44 and the bottom plate 46 is formed in the center portion in the height direction of the side surface of the floor panel 40, however, can be formed at the other positions in the height midstream portion of the side surface of the floor panel 40 without being limited to the position mentioned above.

Further, in the floor panel 40 according to the embodiment mentioned above, the connection portion 44*m* is formed so as to have the inclined surface which is inclined at the predetermined angle from the lower end portion of the side plate portion 44*b* of the top plate 44 toward the inner direction of the floor panel 40, and the connection portion 46*m* is formed so as to have the inclined surface which is inclined at the predetermined angle from the upper end portion of the side plate portion 46*b* of the bottom plate 46 toward the inner direction of the floor panel 40, however, the connection portions 44*m* and 46*m* are not limited to these shapes.

For example, the connection portions 44*m* and 46*m* may be formed as a vertical plate shape which connects so that approximately perpendicular steps are respectively formed between the side plate portions 44*b* and 46*b*, and the concave portions 44*k* and 46*k*, or may be formed so that a vertical cross section of the inclined surface of each of the connection portions 44*m* and 46*m* is formed as a circular arc shape.

Further, in the floor panel 40 according to the embodiment mentioned above, the peripheral edge portion 44*j* of the top plate 44 and the peripheral edge portion 46*j* of the bottom plate 46 are folded like the U-shaped form so as to enwrap each other, whereby the top plate 44 and the bottom plate 46 are connected by the joint portion 45, as shown in FIG. 4, however, the folding method is not limited to the above, but, for example, the folding number of the peripheral edge portions 44*j* and 46*j* and the lengths thereof may be different.

Further, in the floor panel 40 according to the embodiment mentioned above, the plate-like reinforcing member 50 using the particle board is installed within the internal space 48, however, the other wooden material than the particle board may be installed within the internal space 48, a reinforcing member formed by the other materials than the wooden material may be installed within the internal space, or nothing may be installed within the internal space 48.

In the case that the reinforcing member formed by the other material such as a mortar than the wooden material is used, a fluid material may be filled, for example, from a hole formed in the top plate portion 44*a* into the internal space 48 of the floor panel 40 which is formed by the upper member 44 and the lower member 46 so as to be solidified according to passage of time, in place of the member formed as the plate shape.

Further, the floor panel 40 according to the embodiment mentioned above is formed by using a steel plate member, however, may be formed by using the other material such as an aluminum without being limited to the steel plate material.

Figure 8:
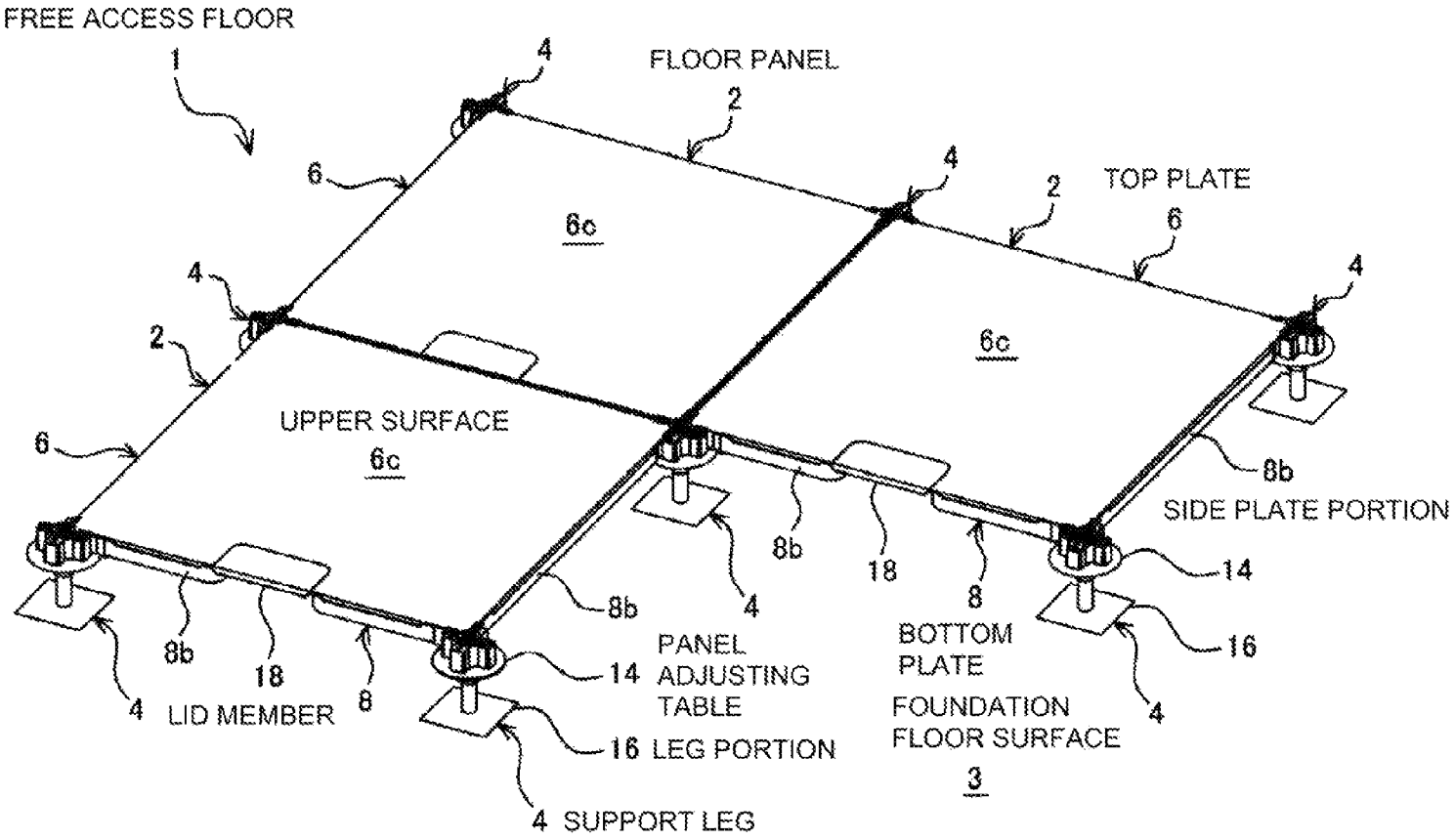
FIG. 8 is a partly perspective view showing a conventional free access floor 1 which is constructed by a conventional floor panel 2, and support legs 4 supporting the floor panel 2.
Figure 9:
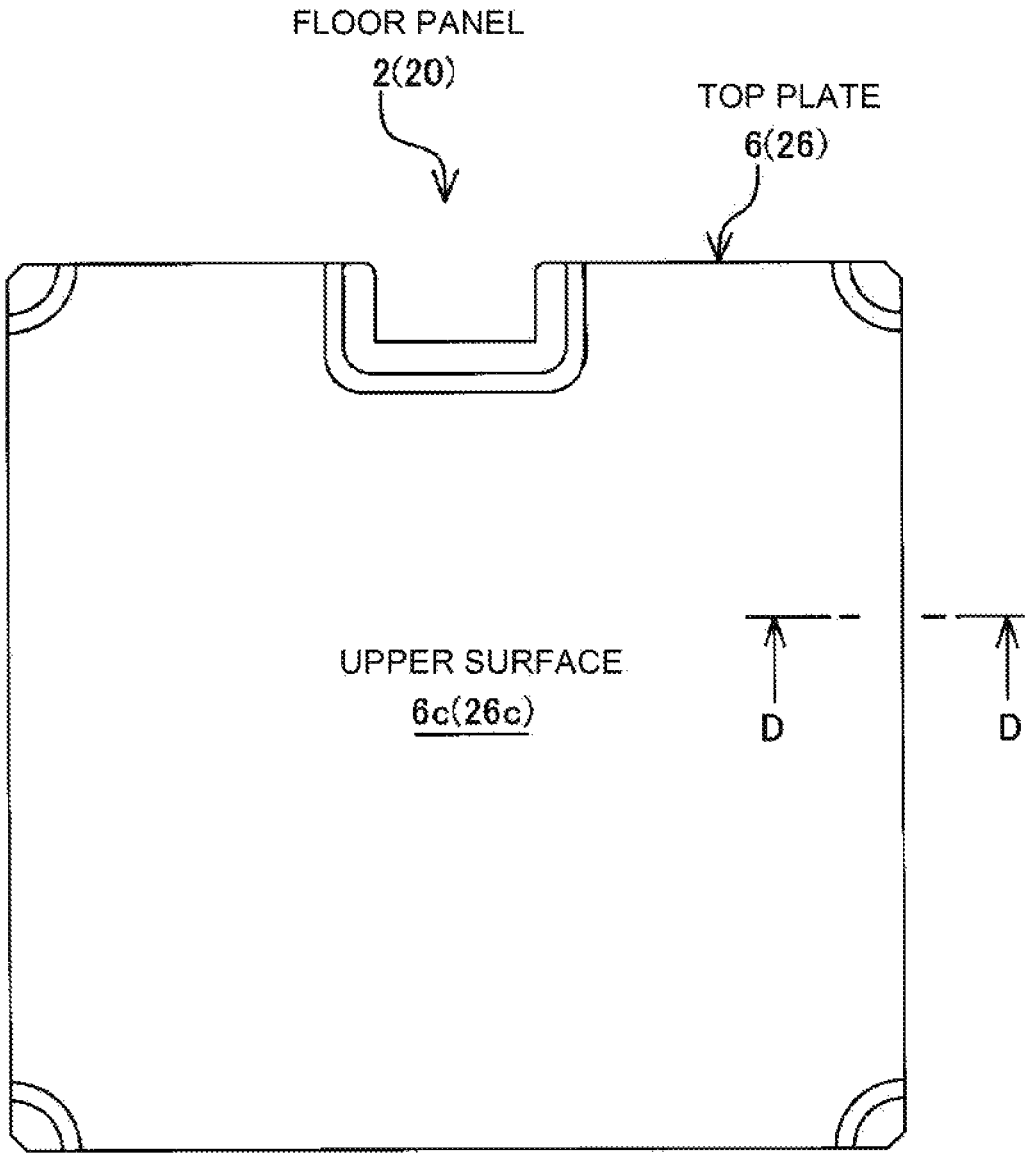
FIG. 9 is a top elevational view of the conventional floor panel 2 or 20.
Figure 10:
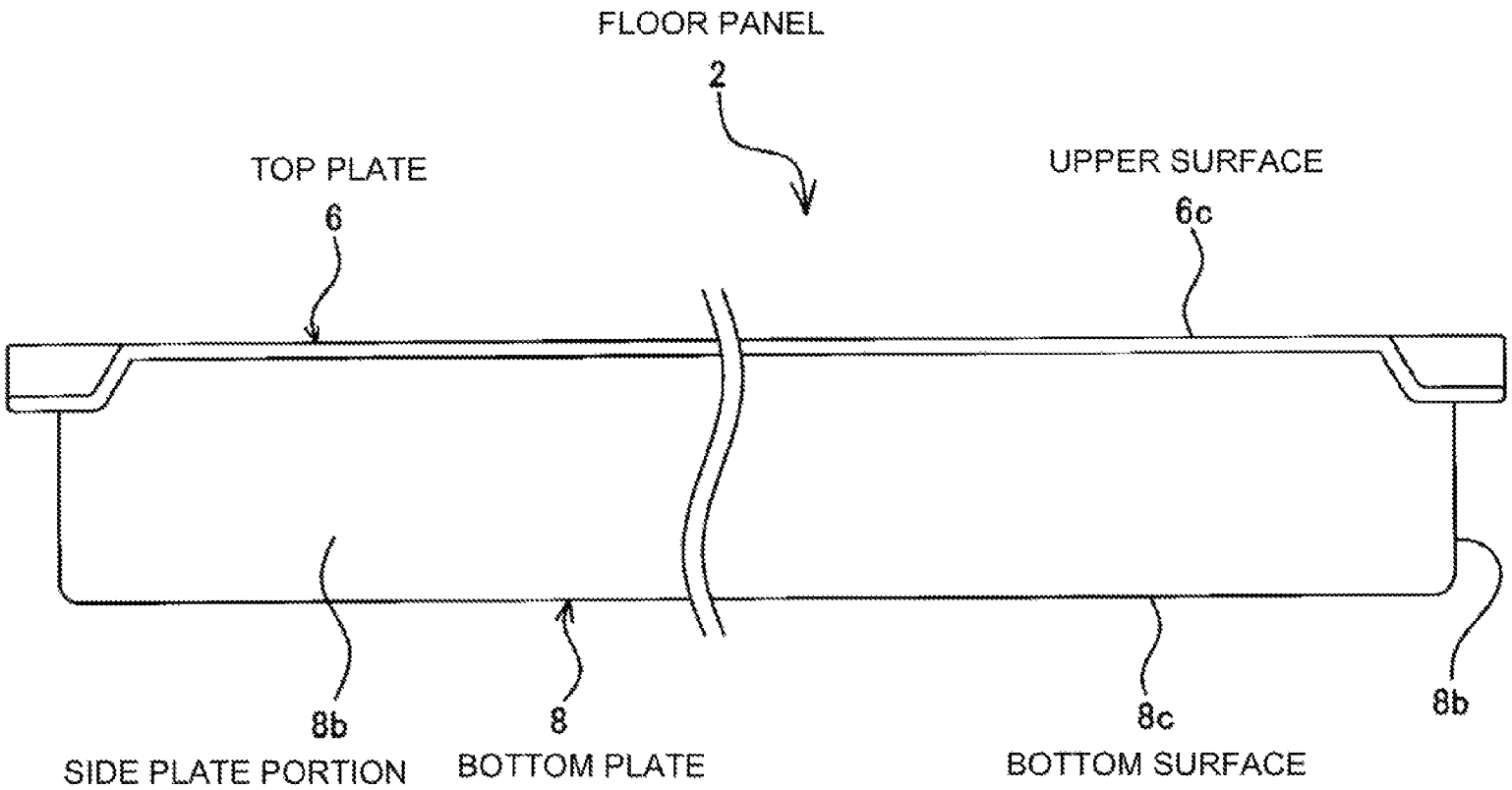
FIG. 10 is a side elevational view showing an outline of the floor panel 2 shown in FIG. 9.
Figure 11:
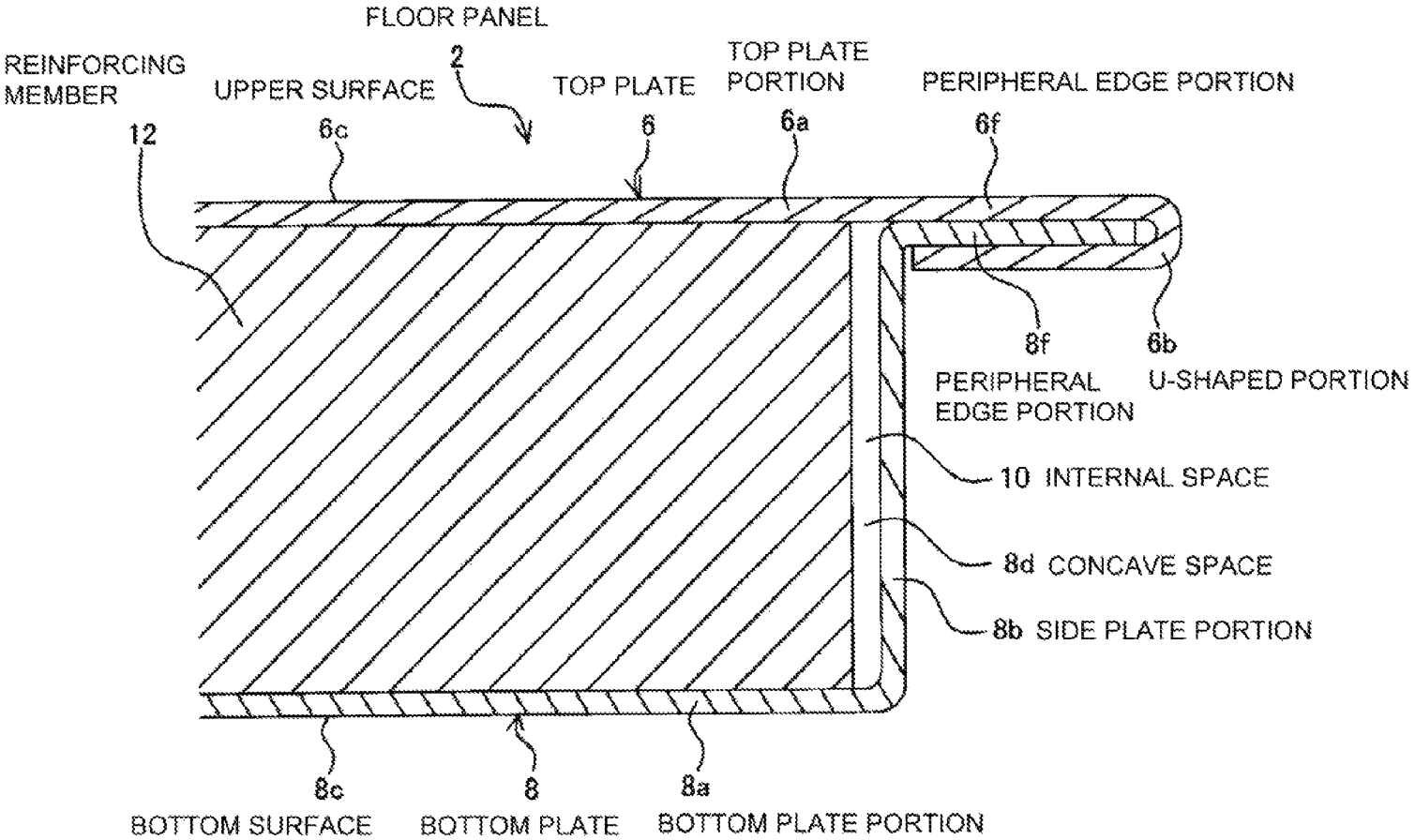
FIG. 11 is a cross sectional view of the floor panel 2 shown in FIG. 9 as seen from an arrow D-D.
Figure 12:
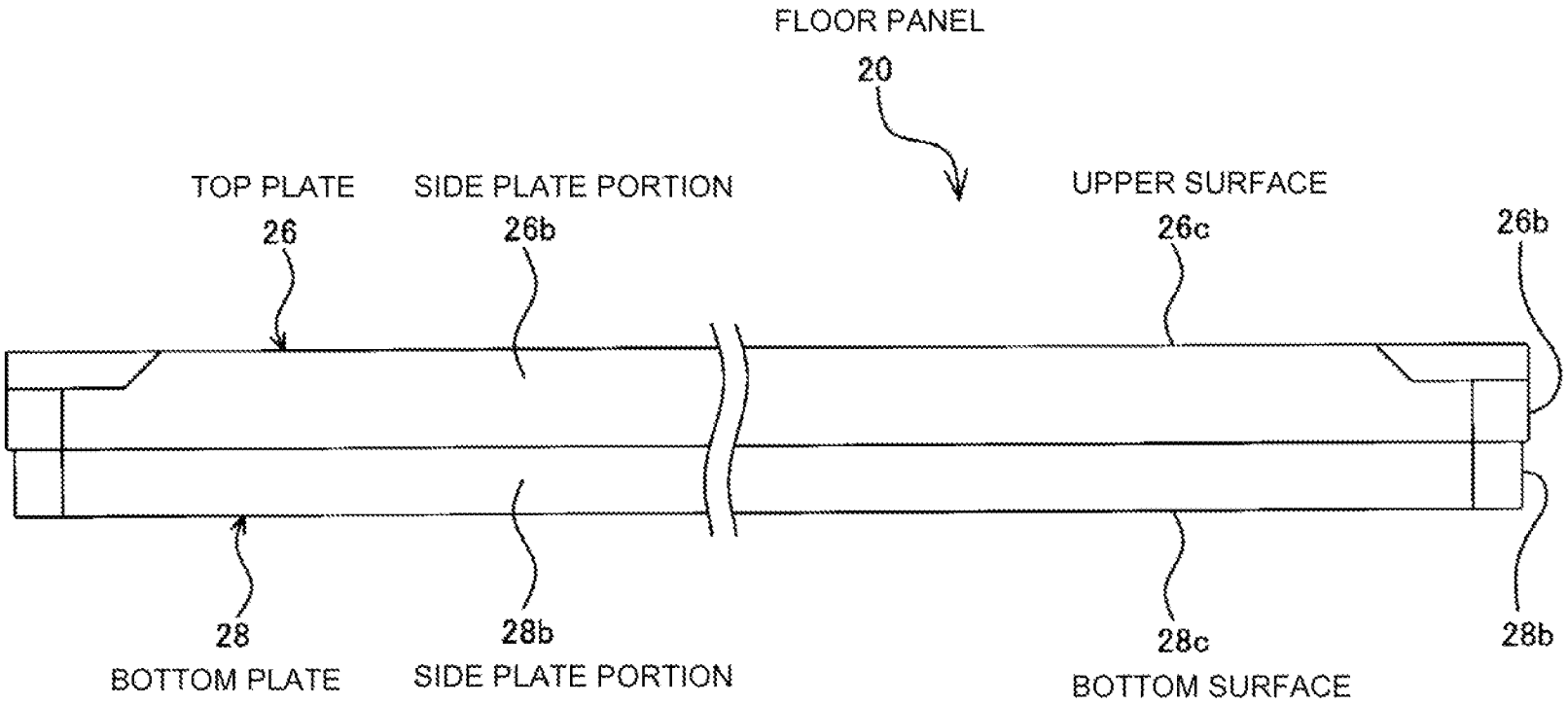
FIG. 12 is a side elevational view showing an outline of the floor panel 20 shown in FIG. 9.
Figure 13:
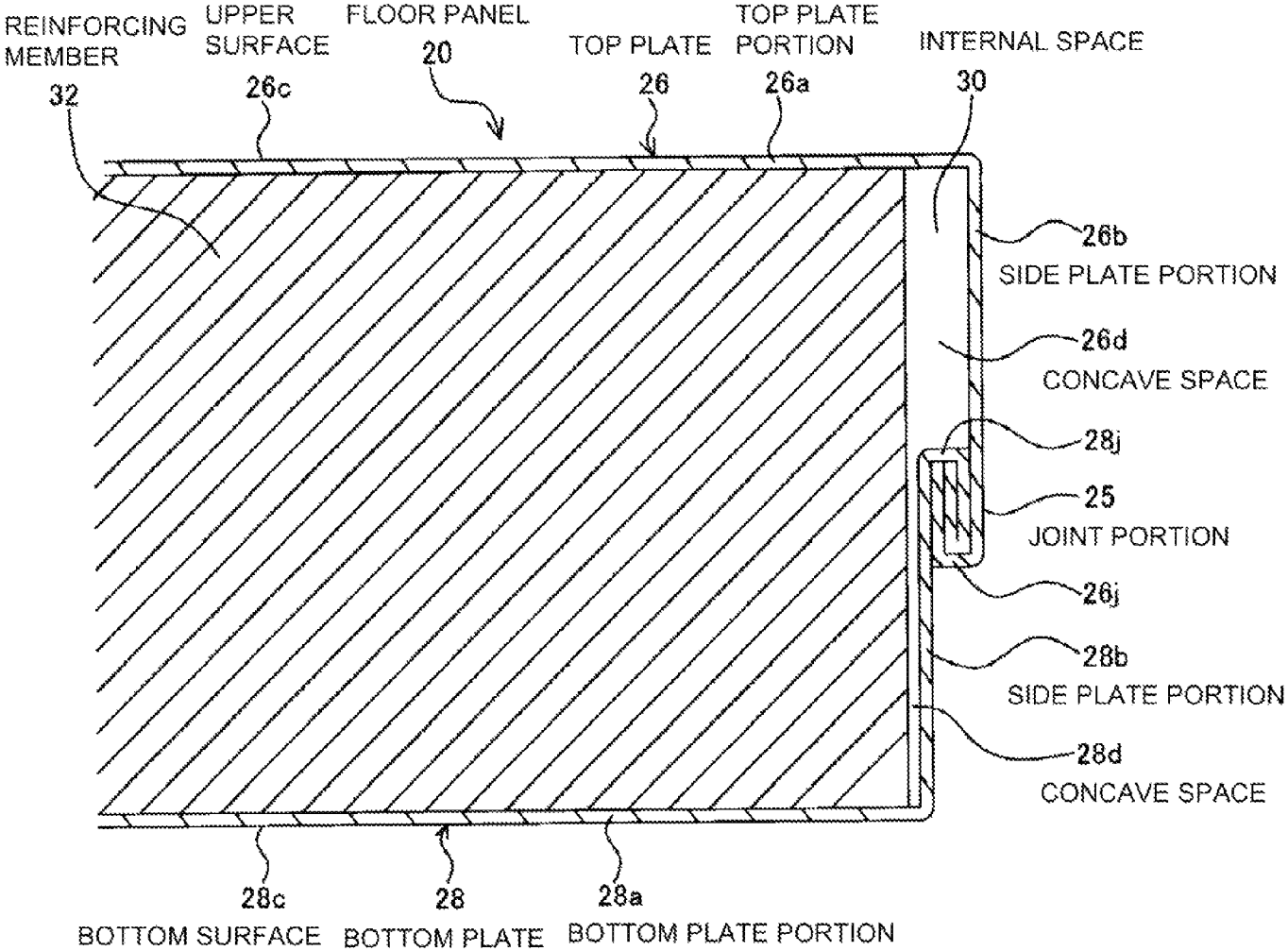
FIG. 13 is a cross sectional view of the floor panel 20 shown in FIG. 9 as seen from the arrow D-D.
Figure 14:
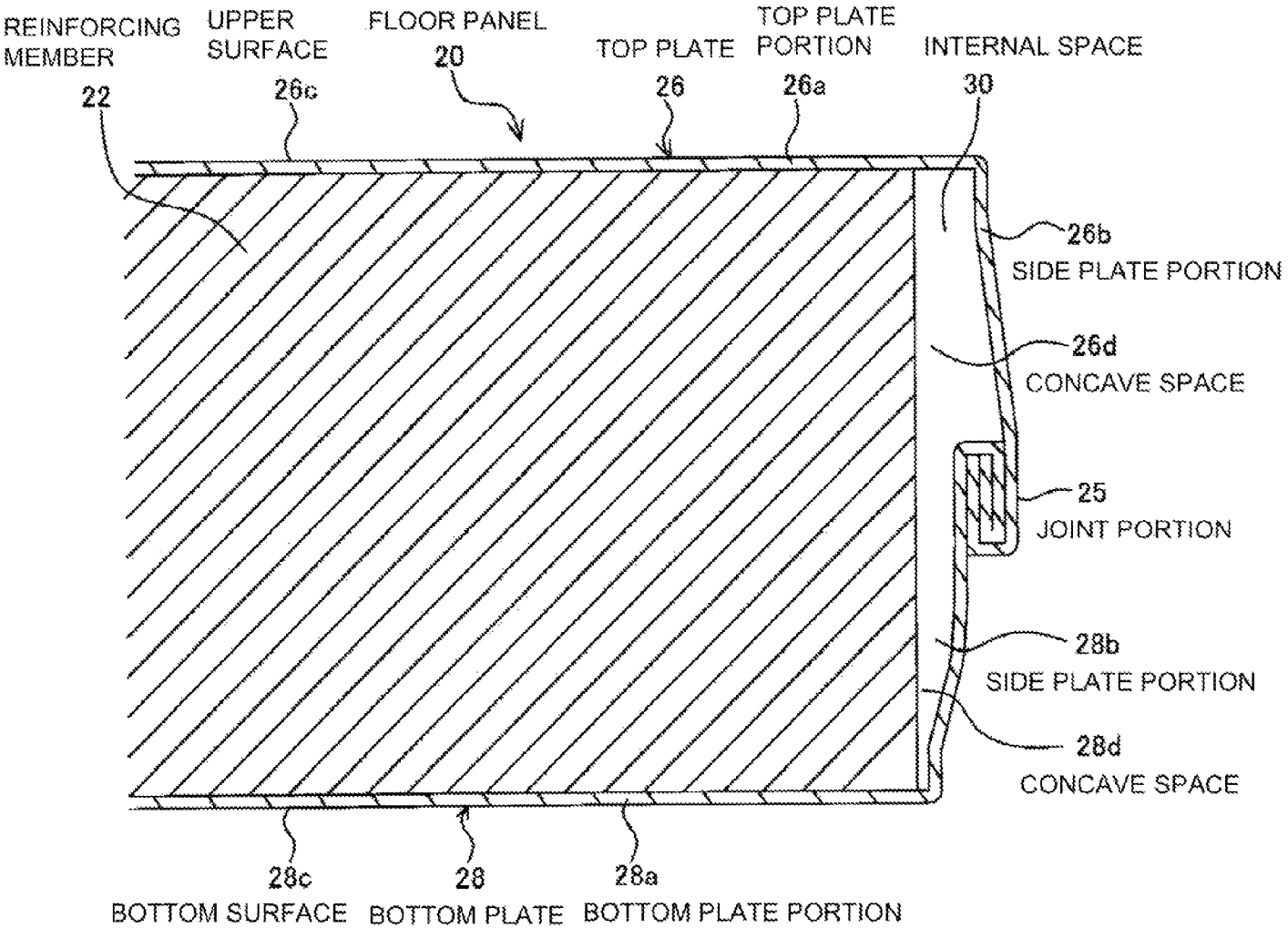
FIG. 14 is a cross sectional view of the floor panel 20 shown in FIG. 9 as seen from the arrow D-D, and is a view showing a state in which a joint portion 25 protrudes to an outer side in a horizontal direction of the floor panel 20 after a state in FIG. 13.

Further, FIG. 8 shows the case that one support leg 4 put in the center of the drawing supports three floor panels 2 while gathering the corner portions thereof as a matter of convenience for description, however, it goes without saying that one support leg 4 can support four floor panels 2 while gathering the corner portions thereof, and this is an original using way of the support leg 4 and is applied in the same manner to the floor panel 40 according to the present embodiment.

What is claimed is:

1. A floor panel comprising:

an upper member which has an upper surface and a side surface and is formed as a box shape with a concave space;

shape with a concave shape; and said upper member and said lower member being combined at a lower end of the side surface of said upper member and an upper end of the side surface of said lower member so as to communicate the respective concave spaces so as to form an internal space in an inner portion, said side surfaces of the upper member and the lower member defining a side surface of the floor panel, wherein a part of said lower end of the side surface of said upper member and a part of said upper end of the side surface of said lower member are bent toward an inner side of said floor panel to provide an upper concave portion and a lower concave portion formed on the inner side of the floor panel in relation to the side surface of the floor panel, said upper and lower concave portions forming a single indented portion therebetween, wherein said floor panel has a joint portion in which leading end portions of peripheral edge portions of the side surfaces of the upper member and the lower member are folded back on each other so as to enwrap each other so as to be connected, and to form said internal space;

wherein said joint portion is arranged in a midstream portion of the side surface of said floor panel, and arranged in said single indented portion of said floor panel.

2. The floor panel according to claim 1, wherein an upper peripheral edge portion formed in the lower end portion side of said upper concave portion and a lower peripheral edge portion formed in the upper end portion side of said lower concave portion are folded back on each other so as to enwrap each other, whereby said joint portion is formed.

3. The floor panel according to claim 2, wherein said upper member and said lower member are connected in a center portion of the side surface of said floor panel.

4. The floor panel according to claim 2, wherein a reinforcing member is provided in said inner space which is formed between said upper member and said lower member.

5. The floor panel according to claim 3, wherein a reinforcing member is provided in said inner space which is formed between said upper member and said lower member.

6. The floor panel according to claim 1, wherein said upper member and said lower member are connected in a center portion of the side surface of said floor panel.

7. The floor panel according to claim 6, wherein a reinforcing member is provided in said inner space which is formed between said upper member and said lower member.

8. The floor panel according to claim 1, wherein a reinforcing member is provided in said inner space which is formed between said upper member and said lower member.

* * * * *